US008109183B2

(12) United States Patent
Santamarina et al.

(10) Patent No.: US 8,109,183 B2
(45) Date of Patent: Feb. 7, 2012

(54) IMPACT RESISTANT TOOL BIT AND TOOL BIT HOLDER

(75) Inventors: Aland Santamarina, Columbia, MD (US); Michael P. Peters, Lutherville, MD (US); Abhijeet Joshi, Baltimore, MD (US); David N. Johnson, Crook (GB); Hans Peter Paulus, Kandern-Tannenkirch (DE); Matthias Mertmann, Basel (CH); Francesco Butera, Como (IT); Luca Fumagalli, Muggio (IT)

(73) Assignee: Black & Decker Inc., Newark, DE (US)

( * ) Notice: Subject to any disclaimer, the term of this patent is extended or adjusted under 35 U.S.C. 154(b) by 322 days.

(21) Appl. No.: 12/472,623

(22) Filed: May 27, 2009

(65) Prior Publication Data

US 2009/0311061 A1 Dec. 17, 2009

Related U.S. Application Data

(60) Provisional application No. 61/059,363, filed on Jun. 6, 2008, provisional application No. 61/103,352, filed on Oct. 7, 2008.

(51) Int. Cl.
*B25B 23/159* (2006.01)

(52) U.S. Cl. ..... 81/467; 173/211; 81/477

(58) Field of Classification Search ..... 81/467, 81/477; 173/210, 211; 408/143; 464/30, 464/86, 88, 89, 97

See application file for complete search history.

(56) References Cited

U.S. PATENT DOCUMENTS

| | | | | |
|---|---|---|---|---|
| 2,409,385 | A | | 10/1946 | Pletcher |
| 3,744,350 | A | | 7/1973 | Raff |
| 3,832,916 | A | * | 9/1974 | Schoeps ..... 81/464 |
| 3,859,821 | A | | 1/1975 | Wallace |
| 4,362,161 | A | | 12/1982 | Reimels et al. |
| 4,572,041 | A | | 2/1986 | Rissmann |
| 4,619,567 | A | | 10/1986 | Campbell |
| 4,774,864 | A | | 10/1988 | Dossier |
| 4,830,001 | A | | 5/1989 | Walus |
| 4,979,408 | A | | 12/1990 | Hayashi |
| 5,072,650 | A | * | 12/1991 | Phillips ..... 91/375 A |
| 5,123,313 | A | | 6/1992 | Andersson |
| 5,309,799 | A | | 5/1994 | Jore |
| 5,540,527 | A | | 7/1996 | Bohnet et al. |
| 5,704,261 | A | | 1/1998 | Strauch et al. |
| 5,737,983 | A | | 4/1998 | Rennerfelt |
| 5,746,298 | A | | 5/1998 | Krivec et al. |
| 6,053,675 | A | | 4/2000 | Holland et al. |
| RE36,797 | E | | 8/2000 | Eggert et al. |
| 6,123,157 | A | | 9/2000 | Barnes |

(Continued)

FOREIGN PATENT DOCUMENTS

| | | |
|---|---|---|
| DE | 23 35 184 | 1/1975 |

(Continued)

*Primary Examiner* — Debra S Meislin
(74) *Attorney, Agent, or Firm* — Scott B. Markow

(57) ABSTRACT

An impact resistant tool or tool bit holder has an active end for driving a fastener and a shanking end for securing to a power tool. The active end includes a body with a bore to receive the shank and a pocket to receive a damping mechanism. The shank includes an end to engage the bore in the body, and a pocket to receive the damping mechanism. The shank is received in the bore in the body for limited rotation with respect to the body. A damping mechanism is positioned in the pockets to provide damping between the body and the shank during torque loading.

16 Claims, 11 Drawing Sheets

U.S. PATENT DOCUMENTS

| | | | |
|---|---|---|---|
| 6,321,855 | B1 | 11/2001 | Barnes |
| 6,330,846 | B1 | 12/2001 | Strauch |
| 6,345,560 | B1 | 2/2002 | Strauch et al. |
| 6,364,318 | B1 | 4/2002 | Bedi et al. |
| 6,487,943 | B1 | 12/2002 | Jansson et al. |
| 6,568,693 | B2 | 5/2003 | Glass |
| 6,640,911 | B2 | 11/2003 | Lieser et al. |
| 6,644,150 | B2 | 11/2003 | Chen |
| 6,918,913 | B2 | 7/2005 | White |
| RE38,778 | E | 8/2005 | Eggert et al. |
| D516,894 | S | 3/2006 | Singh |
| 7,086,813 | B1 | 8/2006 | Boyle et al. |
| 7,107,883 | B2 | 9/2006 | Casutt |
| 7,150,680 | B2 | 12/2006 | White |
| 7,197,968 | B2 | 4/2007 | Bubel |
| 7,261,023 | B2 | 8/2007 | Taguchi |
| 7,318,691 | B2 | 1/2008 | Osburn |
| D589,319 | S | 3/2009 | Peters |
| 2002/0135140 | A1 | 9/2002 | Mitchell et al. |
| 2004/0099106 | A1 | 5/2004 | Strauch et al. |
| 2006/0254786 | A1 | 11/2006 | Murakami et al. |
| 2007/0114050 | A1 | 5/2007 | Baumann et al. |
| 2008/0060849 | A1 | 3/2008 | Entchev et al. |
| 2008/0107491 | A1 | 5/2008 | Osburn |
| 2008/0217870 | A1 | 9/2008 | Shibata |

FOREIGN PATENT DOCUMENTS

| | | |
|---|---|---|
| DE | 34 37 083 | 4/1986 |
| DE | 41 43 218 | 9/1992 |
| DE | 198 43 452 | 3/2000 |
| DE | 41 43 678 | 3/2005 |
| DE | 20 2005 017 686 | 2/2006 |
| DE | 10 2006 021 506 | 11/2006 |
| DE | 10 2005 057 368 | 6/2007 |
| EP | 0 988 134 | 5/1998 |
| JP | 04-141332 | 5/1992 |
| JP | 2007-190666 | 8/2007 |
| WO | WO 2007/104286 | 9/2007 |

* cited by examiner

IMPACT RESISTANT TOOL BIT AND TOOL BIT HOLDER

CROSS REFERENCE TO RELATED APPLICATIONS

This application claims priority, under 35 U.S.C. §119(e), to U.S. Provisional Application No. 61/059,363, filed Jun. 6, 2008, titled "Screwdriving Tool with Damper," and U.S. Provisional Application No. 61/103,352, filed Oct. 7, 2008, titled "Tool Holder", which are incorporated herein by reference.

TECHNICAL FIELD

This application relates to accessories for power tools and, more specifically, to a tool bit and/or tool bit holder that includes a damper to make the bit or bit holder resistant to breakage when used in an impact driver.

BACKGROUND

When an impact driver is utilized to drive fasteners, such as screws, into a workpiece, a large driving torque (e.g., approximately 500 inch-lbs) is generated in rapid cycles (e.g., approximately every 2 milliseconds). Due to the large driving torque and the rapid cycling, current tool bits (e.g., screwdriving bits) and/or bit holders often fail when used with impact drivers. This may be due to the fact that the tool bits and bit holders often have a lower torque rating (e.g., approximately 200 inch-lbs) than the torque rating of the impact driver. It would be desirable to have a tool bit or a holder for a screwdriving bit that can withstand the torque loading of an impact driver.

SUMMARY

This application discloses a tool bit and/or a bit holder with a damper, which enables the tool bit and/or bit holder to dissipate large and dynamic torque loading from an impact driver, while smoothly delivering torque, e.g., to a fastener such as a screw. The tool bit or bit holder dissipates a sufficient amount of energy to prevent the peak torque from exceeding the strength of the tool bit or bit holder, without breaking the tool bit or bit holder.

It is an aspect of the present disclosure to provide a tool bit holder that comprises a tool holder body defining an axis and having a first and second end. The first end has a tool receiving bore and the second end has a shank receiving bore. The holder body includes a pocket between the first and second ends. The pocket receives a damping mechanism. The pocket is defined by a plurality of walls that define an overall rectangular bore. At least one wall includes a recess portion. The recess portion receives material from the damping mechanism during deformation of the damping mechanism caused by dynamic torque loading from an impact driver onto the tool bit holder. A shank defines an axis. The shank has a first and second end. The first end of the shank has a mating configuration with the tool holder shank receiving bore and is received in the shank receiving bore of the holder body. The shank first end is rotatable in the shank receiving bore. The shank second end includes a configuration to mate with a chuck or the like of a power tool. A pocket is formed in the shank between the first and second ends. The pocket receives a portion of a damping mechanism. The pocket is defined by a plurality of walls that define an overall rectangular bore. At least one wall includes a recess portion to receive material from the damping mechanism during deformation. A rotation limiting mechanism is coupled with the holder body and the shank. The rotation limiting mechanism limits rotation of the holder body and shank with respect to one another. The rotation limiting mechanism includes at least one pin positioned in a recess, in the holder body and the shank. A damping mechanism is received in the holder body and shank pockets. The damping mechanism has a rectangular configuration that fits into the pockets rectangular bores. The damping mechanism is made from a shape memory material, such as a nitinol alloy. The recess portions are defined by at least one surface extending away from one of the walls. The surface forms an acute angle with respect to one of the walls forming a wedge shaped void to receive the deformed material.

In accordance with a second aspect of the disclosure, an impact resistant tool comprises an active end to drive a fastener. The active end includes a body defining an axis. A bore is in the body to receive a shank. A pocket is formed in the body to receive a damping mechanism. A shank is to be secured with a power tool. The shank includes an end to engage the bore in the body. The shank includes a pocket to receive the damping mechanism. The shank has a limited rotation with respect to the body. A damping mechanism is positioned in the pockets to provide dampening between the body and the shank caused by dynamic torque loading of the tool. The active end may include a tool bit or tool bit holder. The active end may include a fastening bit, including a bit having a flat head, a socket head, a Phillips head, a Torx® head, a star head, a socket head or the like, or a drilling bit. The holder may include, e.g., a pivoting holder, a quick release holder, a drop and load holder, all including a receiving bore. The pockets further comprise at least one transition zone to receive material from the damping mechanism as it deforms in response to dynamic torque applied onto the tool. A mechanism for limiting rotation of the body with respect to the shank is coupled with the body and the shank.

According to a third aspect of the disclosure, a tool bit holder includes a shanking end to couple it with a powered driver. A body is coupled with the shanking end. A tool bit receiver is coupled with the body. The tool bit receiver includes a mechanism to receive a tool bit. A damping mechanism is internally positioned within the body. The damping mechanism provides torsional dampening between the shanking end and the tool bit receiver. The damping mechanism is coupled between the body and the tool bit receiver. The damping mechanism is of a shape memory material, e.g., a nitinol alloy. The damping mechanism enables torsional twisting with respect to one another. A bearing is positioned between the body and the tool bit receiver.

According to a fourth aspect of the disclosure, a screwdriving tool or holder includes an active end and a shanking end separated by a damping mechanism. The active end may include a fastening end, including an end having a flat head, a socket head, a Phillips head, a Torx® head, a star head, a socket head or the like, a drilling end, or a receptacle for receiving a fastening or drilling bit. The shanking end may be hexagonal with a groove to be received in an impact driver. The damping mechanism is a torsional biasing member. The biasing member may include a helical torsion spring, an energy absorbing material, a memory shape metal, or the like.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
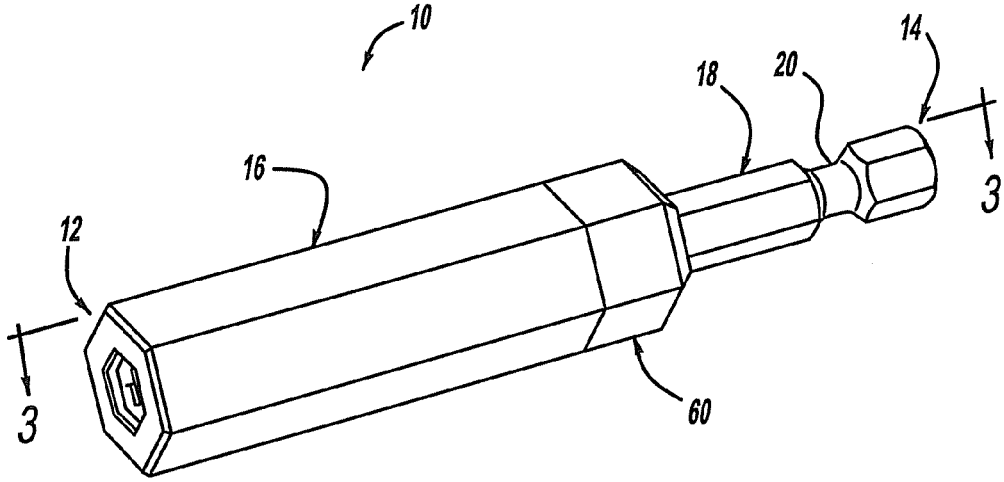
FIG. 1 is a perspective view of an impact resistant tool bit holder.

Turning to FIG. 1, an impact resistant tool bit holder is illustrated and designated with the reference numeral 10. The tool bit holder 10 includes an active end 12 and a shanking end 14. The active end 12 may include a tool holder body 16 as illustrated or a tool may be unitarily formed with the holder body 16. The shanking end 14 includes a shank 18 that has an overall hexagonal cross-section as well as a groove 20. The shank 18 enables tool 10 to be positioned into a chuck or the like of a power tool or impact driver.

Figure 4:
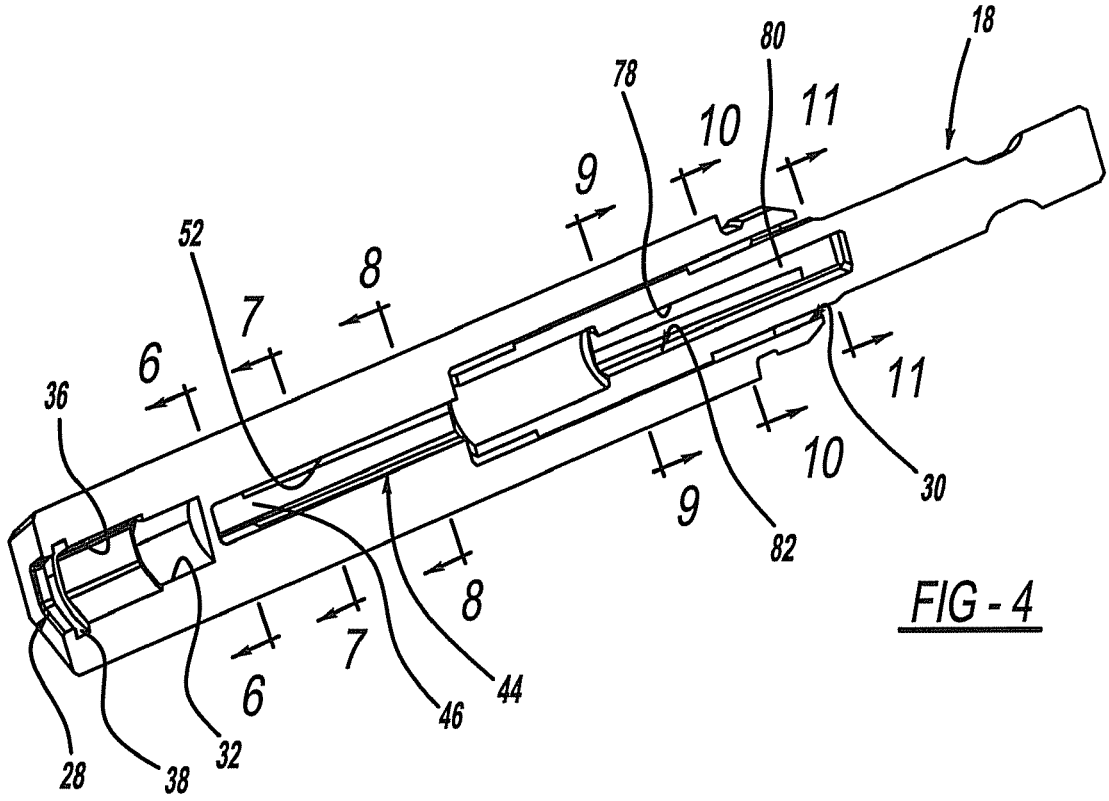
FIG. 4 is a view like FIG. 3 with the damping bar removed.
Figure 5:
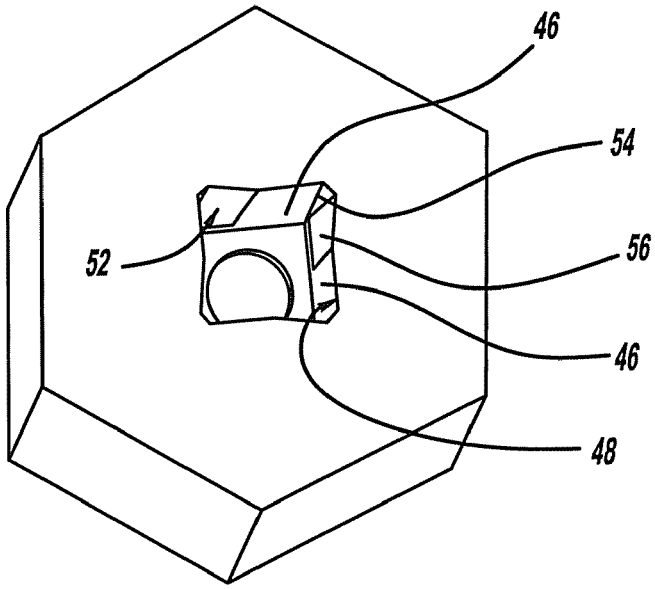
FIG. 5 is a perspective view along arrow 5 of FIG. 2.
Figure 6:
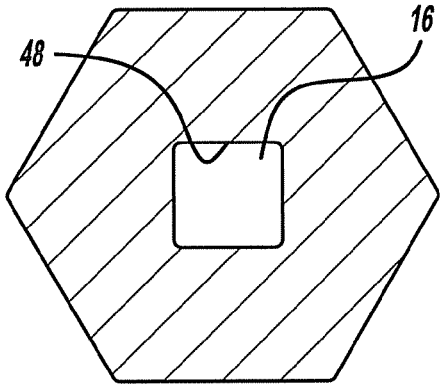
FIG. 6 is a cross-section view of FIG. 4 along line 6-6 thereof.

The holder body 16 has an overall cylindrical configuration illustrated with a hex shaped outer surface. The holder body 16 includes a first end 22 and a second end 24. Also, the holder body 16 defines an axis 26 extending through the body. The first end 22 includes a bit receiving bore 28. Likewise, the second end 24 includes a shank receiving bore 30. The bit receiving bore 28 has a first portion 32 designed to receive a cylindrical magnet 34. A second portion 36 is defined by hexagonal walls to receive a tool bit. Additionally, a groove 38 is positioned toward the end 22 to receive a ring 40. The ring 40 cooperates with detents on the tool bits to maintain the tool bits in the second bore portion 36. It should be understood that, the first end may instead have a bit retention mechanism such as a pivoting holder, a quick-release holder, or a drop and load holder, e.g., as illustrated in Assignee's U.S. Des. Pat. No. D589,319, issued Mar. 31, 2009, entitled "Pivoting Bit Holder" and Assignee's U.S. patent application Ser. No. 11/322,183, filed Dec. 29, 2005, entitled "Universal Tool Bit Shank, which are hereby incorporated by reference The shank receiving bore 30 is defined by a right cylindrical wall 42 to receiving a portion of the shank 18. The bores 28 and 30 terminate inside of the body 16. A pocket 44 is formed between the bores 28 and 30. The pocket 44 may be a blind pocket or it may extend from one bore to the other. The pocket 44 is defined by a plurality of walls 46. The walls 46 are substantially identical and define a polygonal cross-section 48, e.g., a rectangular or square cross-section. The pocket 44 receives a portion of the damping mechanism 50. The walls 46 include recesses or transition portions 52, which will be described in more detail below. The pocket 44 extends from a desired point along the wall 42 toward the second bore 30 as seen in FIGS. 4 and 5.

Additionally, the second end includes a receiving portion 58 to receive a cap 60 that holds the shank 18 and holder body 16 together. Also, the receiving portion 58 includes a pair of apertures 62 and 64 that receive pins 66 that couple with the shank 18 to limit the rotation of the shank 18 in the holder body 16.

The shank 18 includes a first end 68 and the shanking end 14. The first end 68 has an overall cylindrical outer surface in the shape of a right cylinder. The cylinder 70 includes a pair of smaller cylindrical portions 72 and 74 that receive bearing sleeves 76. The bearing sleeves 76 enhance the rotation of the shank 18 with respect to the holder body 16. The first end 68 includes a pocket 78. The configuration of pocket 78 is like that of pocket 44. Accordingly, pocket 78 includes walls 80 that define a bore of polygonal cross-section, e.g., rectangular or square. The pocket receives 78 a portion of the damping mechanism 50. The walls 80 include recesses or transition portions 82, which will be described in more detail below. The pocket 78 extends from a desired point along the wall toward the first end 68.

Additionally, the cylindrical portion 74 includes a pair of recesses or stops 88. The recesses 88 receive the pins 66 to limit the rotation of the shank 18 with respect to the body 16. The recesses 88 act like a stop to prohibit movement once they encounter the pins 66. Thus, the pins 66 and recesses 88 act as a rotational limiting device.

Figure 3:
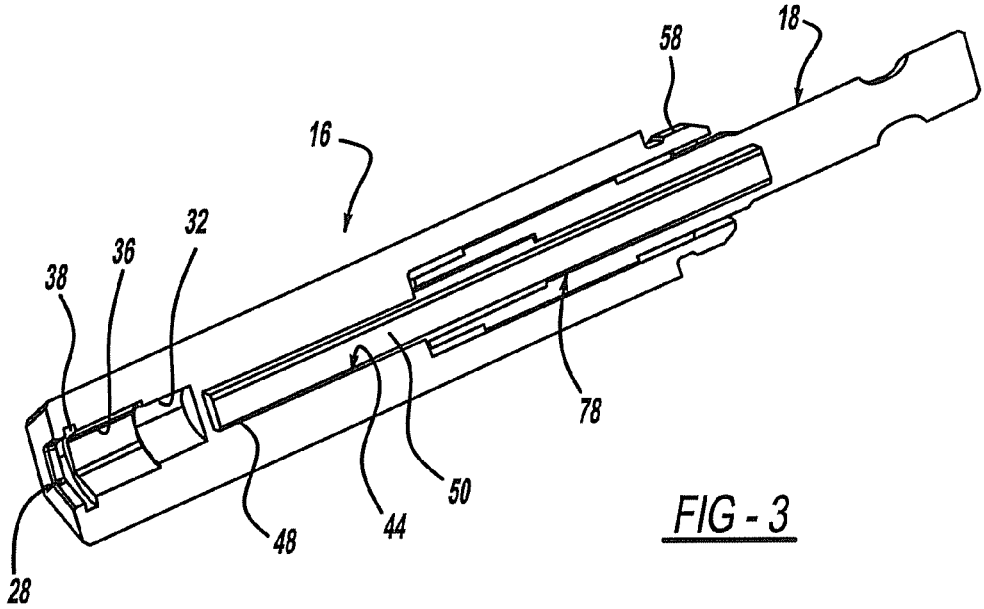
FIG. 3 is a cross-section view of FIG. 1 along line 3-3 thereof.
Figure 2:
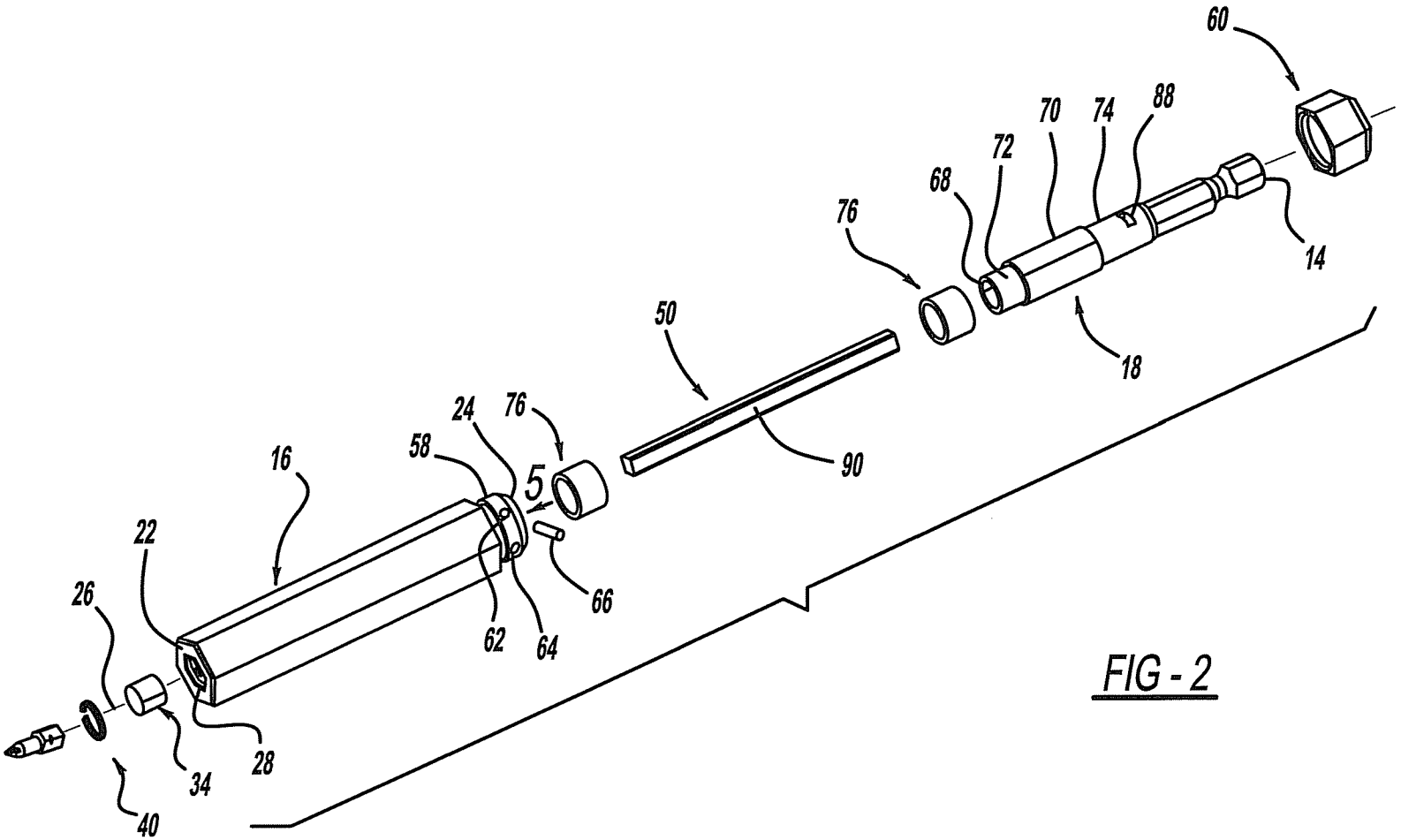
FIG. 2 is an exploded view of FIG. 1.

The damping mechanism 50 comprises a damping bar having a cross-sectional shape that is substantially similar to the cross-sectional shape of pockets 44 and 78, e.g., substantially rectangular or square. The bar has a length set as a minimum that maintains the required cycled life. The damping mechanism 50 has surfaces 90 that are substantially flat planar surfaces. The damping mechanism 50 is positioned into the pockets 44 and 78 as illustrated in FIG. 3. In this position, the damping mechanism 50 maintains the shank 18 and holder body 16 together. The damping mechanism 50 is made of a material that provides for damping of the torsional forces that are applied to the holder 10. For example, the damping mechanism 50 can be manufactured from a shape memory material, such as a nitinol alloy, an elastomeric material, a resin material, or a spring, such as a helical spring, leaf spring or the like. The damping mechanism enables the dissipation of stored energy as the mechanism returns to its original shape.

Figure 24:
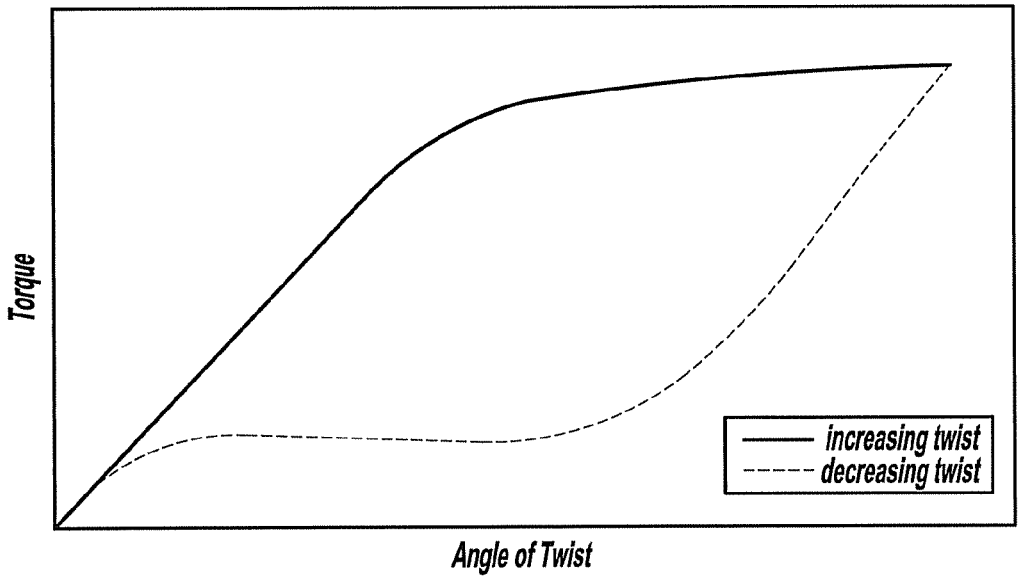
FIG. 24 is a graph showing torque versus angle of twist for a damping mechanism.

For example, if the bar is made from nitinol alloy, the energy may be dissipated as the material transitions from austentite to martensite and back to martensite. Initially, the crystal structure is in an austenite phase. When stress develops, the material transitions to martensite. Martensite is unstable and when the stress is removed it returns to the austenite phase. A torque versus angle of twist graph shows a typical nitinol torsion bar as it is twisted to some arbitrary angle (see FIG. 24). It is then allowed to return to its original state. The area under the curve represents the energy required to twist the bar. Since the area under curve is greater during the twisting portion of the cycle than during the un-twisting portion, the energy has been dissipated.

The transition portions 52, 82 reduce the stress concentrations that develop in the torsion bar at the bar-shank interface and bar-holder interface. The gradual transitions from the rigidly mounted ends to the free section of the bar help support the bar as it is twisted to its maximum angle. Without the transition portions 52, 82, the same region will take the entire load as it is twisted. But, with this type of support, the load is distributed over a much larger area.

Figure 7:
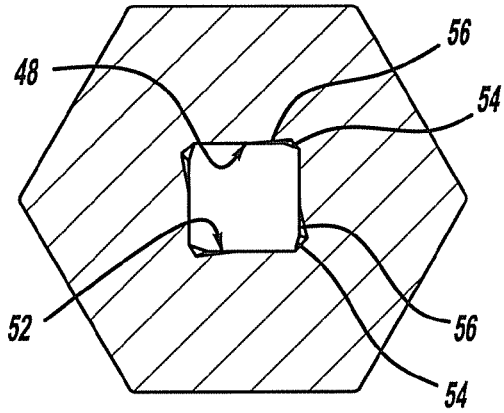
FIG. 7 is a cross-section view of FIG. 4 along line 7-7 thereof.
Figure 8:
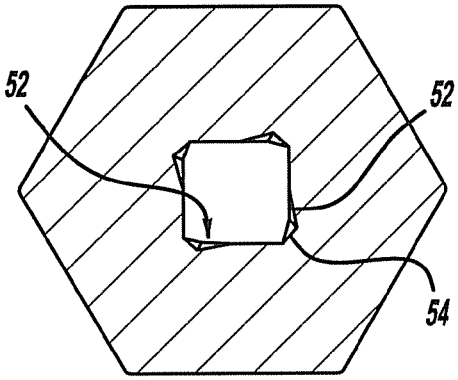
FIG. 8 is a cross-section view of FIG. 4 along line 8-8 thereof.

The pocket walls 46 each include a recess or transition portion 52. The recesses 52 are defined by a pair of surfaces 54 and 56. The surfaces 54 and 56 extend outwardly from the axis of the holder body 16. Surface 54 has an overall triangular shape and is positioned at the vertex of adjoining walls 46. Surface 56 has an overall rectangular shape. It should be realized that other surface shapes may be used as long as they provide an increased surface area. The surfaces 54 and 56 are angled at acute angles with respect to the axis and walls 46. The distance from the walls 46 to the surfaces 54, 56 increases towards the open end of the pocket as illustrated in FIGS. 7 and 8. Thus, the recess 52 defines a wedge shape void or transition space or zone. Accordingly, when dynamic torque is applied to the tool, the damping mechanism 50 twists. As this occurs, the damping mechanism 50 deforms so that the wedge shaped transition space 52, 82 receives material from the damping mechanism 50. Thus, due to the increased surface area provided by the surfaces of the transition recesses or wedges 52, 82, they prevent stress concentration to prevent prematurely breaking of the damping mechanism.

Figure 9:
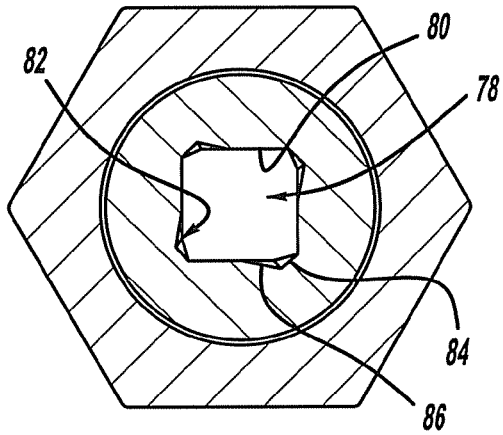
FIG. 9 is a cross-section view of FIG. 4 along line 9-9 thereof.
Figure 10:
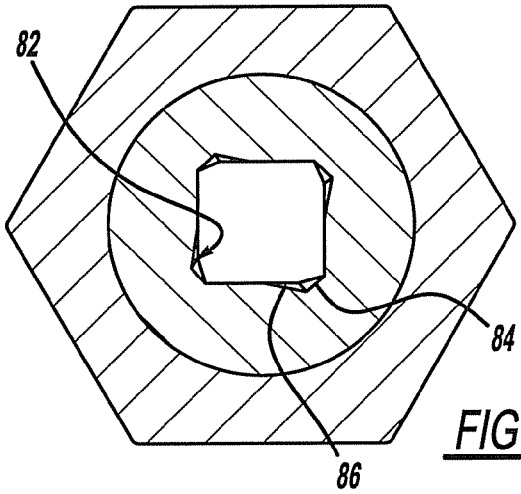
FIG. 10 is a cross-section view of FIG. 4 along line 10-10 thereof.
Figure 11:
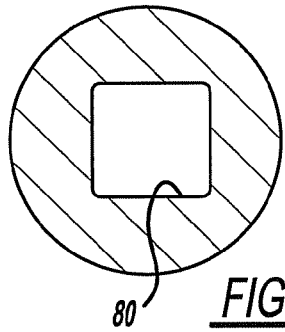
FIG. 11 is a cross-section view of FIG. 4 along line 11-11 thereof.

The pocket walls 80 each include a recess or transition portion 82. The recesses 82 are defined by a pair of surfaces 84 and 86. The surfaces 84 and 86 extend outwardly from the axis of the holder body 16. Surface 84 has an overall triangular shape and is positioned at the vertex of adjoining walls 80. Surface 86 has an overall rectangular shape. It should be realized that other surface shapes may be used as long as they provide an increased surface area. The surfaces 84 and 86 are angled at acute angles with respect to the axis and walls 80. The distance from the wall 80 to the surfaces 84, 86 increases towards the open end of the pocket as illustrated in FIGS. 9 and 10. Thus, the recess 82 defines a wedge shape void or transition space or zone. Accordingly, when the dynamic torque is applied to the tool, the damping mechanism twists. As this occurs, the damping mechanism 50 deforms so that the wedge shaped transition space 52, 82 receives material from the damping mechanism 50. The transition recesses or wedges 52, 82 prevent stress concentration to prevent prematurely breaking the bar.

Figure 12:
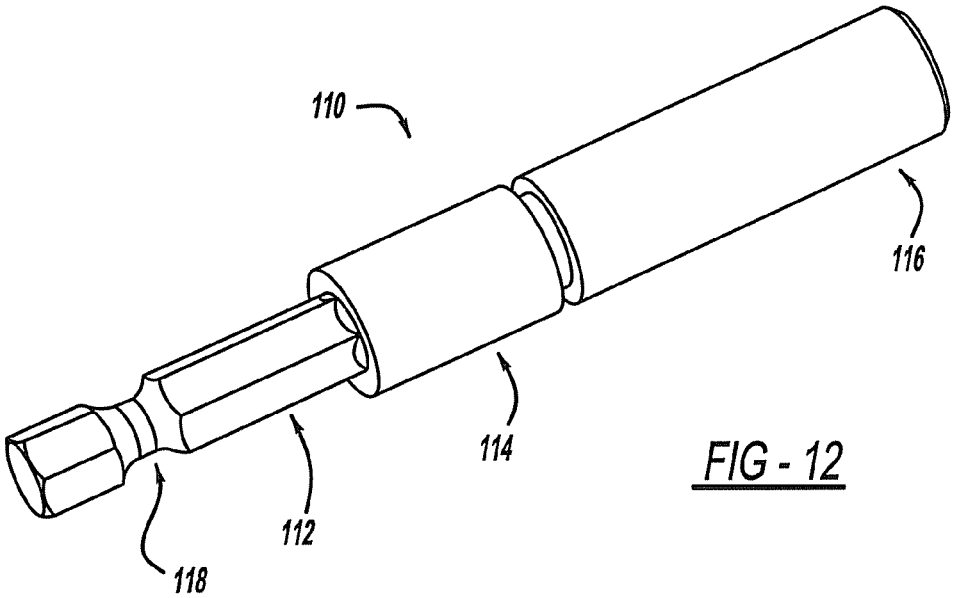
FIG. 12 is a perspective view of a tool holder in accordance with the present disclosure.

Turning to the figures, FIG. 12 illustrates a perspective view of another embodiment of a tool holder designated with the reference numeral 110. The tool holder 110 includes a shanking end 112, a body 114 and a tool bit receiving member 116. The shanking end 112 has a generally hexagonal cross-sectional shape with a groove 118. The shanking end 112 is to be received into an impact driver or drill motor. The body 114, as well as the bit receiving member 116, has an overall right circular cylindrical shape; however, any type of right cylindrical shape may be utilized.

Figure 13:
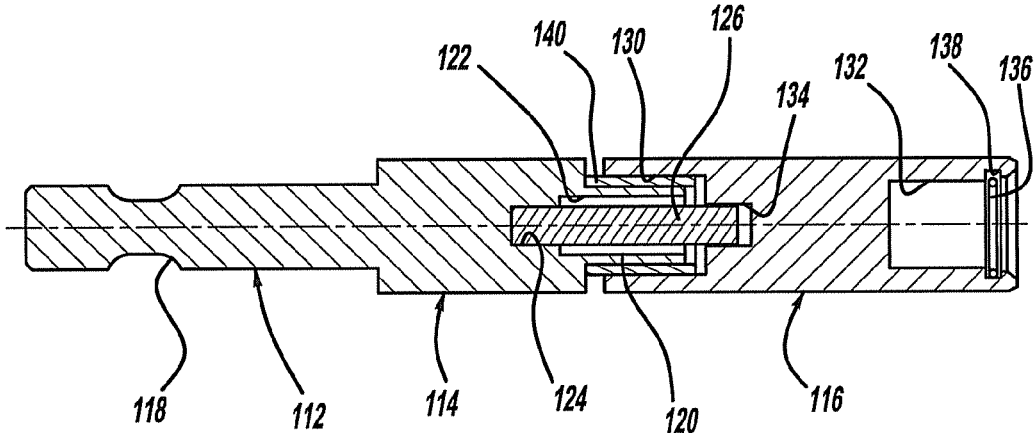
FIG. 13 is a cross section view of FIG. 12.
Figure 14:
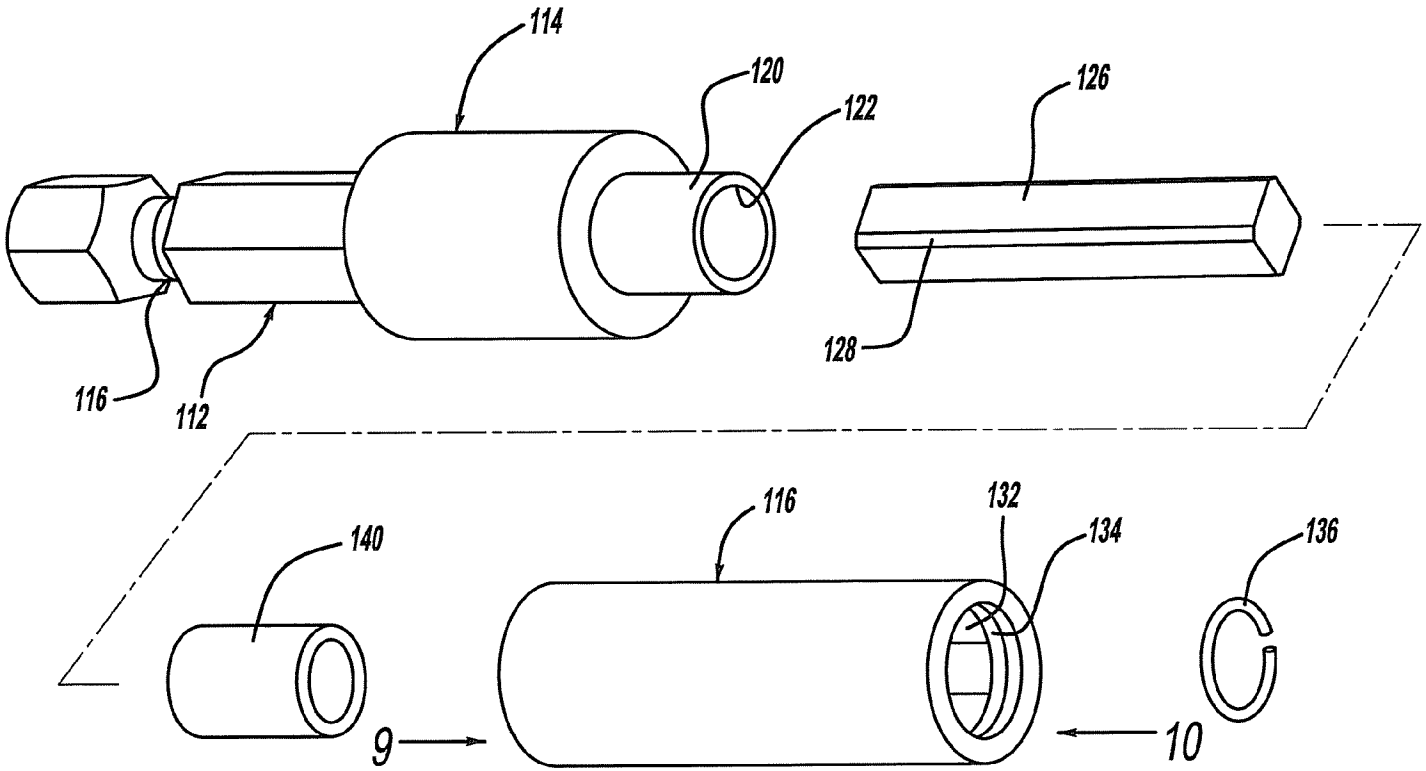
FIG. 14 is an exploded perspective view of FIG. 12.

The body 114 may be welded or connected with the shanking end 112. Alternatively, the body 114 and shanking end 112 may be a unitary single piece. The body 114 includes a projecting portion 120. The projecting portion 120 has a right cylindrical shape having a smooth outer surface. A circular bore 122 is formed into the projecting member 120. The bore 122 extends through the projecting member 112 into the body 114 as shown in FIG. 13. At the terminus of bore 122, a second bore 124 extends from it. The extending bore 124 has a polygonal, e.g., rectangular or square, cross-sectional shape. The polygonal cross-sectional shape receives a damper bar 126.

The damping mechanism 126 has an overall polygonal, e.g., rectangular or square, cross-sectional shape with chamfered corners 128. The damping mechanism 126 has a desired length as well as height and width. The damping mechanism 126 cross sectional dimension is sized so that it is press fit into the extending bore 124 to secure the damping mechanism 126 and the holder body 114 together. The damping mechanism 126 provides torsional twisting movement. The damping mechanism 126 is manufactured from a memory metal material, such as nitinol. This material provides desired dampening characteristics. The memory metal material provides plastic deformation when torque is present. It provides damping from the impact driver to the tool bit. When the torque is removed, the memory metal material springs back to its original position.

Further, other dampers may be utilized to provide the desired characteristics. These dampers may be springs of various types, such as helical, leaf or the like. Additionally, polymeric materials may be used.

Figure 15:
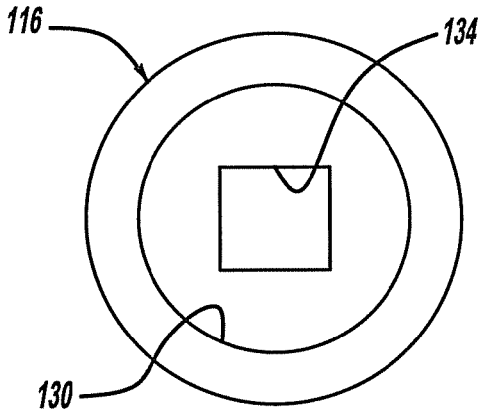
FIG. 15 is a plan view along arrow 15.
Figure 16:
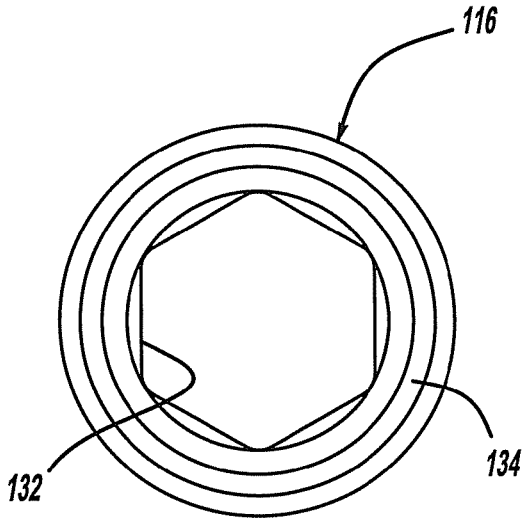
FIG. 16 is a plan view of the tool bit receiver along arrow 16.

The tool bit receiving member 116 has an overall right circular cylindrical shape. The tool receiving member 116 includes two bores 130 and 132, one on each end of the tool bit receiving member 116. The bore 130 is like the bore 122 including a circular cross-section bore. A polygonal, e.g., rectangular or square, shaped bore 134 extends from the terminus of the bore 30 (see FIGS. 13 and 15). The polygonal shape bore 134 receives the damping mechanism 126 which is press fit into the bore 134. Thus, the damping mechanism 126 secures the body 114 with the bit receiving member 116 and provides torsional twisting movement between the two. The bore 132 has an overall hexagonal cross section to receive a tool bit (see FIG. 16). Additionally, a second larger bore 138 is formed at the end of the hexagonal bore 132. The second bore 138 receives a C clip 36 that helps to retain the tool bit inside of the hexagonal bore 132.

Additionally, other shaped bores may be used to receive the damping mechanism. The damping mechanism could be a right circular cylinder press fit into circular bores. Further, the damping mechanism could be a flat rectangular bar or leaf, press fit into a mating rectangular shaped bore.

A bearing sleeve 140 is positioned on the projecting portion 120 between the body 114 and the bit receiving member 116. The bearing sleeve 140 is manufactured from an oil impregnated material such as bronze. However, it could be manufactured from various types of plastics or metal material depending upon the design. The bearing sleeve 140 provides for smooth rotation of the bit receiving member 116 with respect to the body 114. The bearing sleeve 40 fits into the bore 130 of the bit receiving member 116.

The damping mechanism 126 is positioned within the body and bit receiving member 116. The damping mechanism 126 is press fit into the bore 124 of body 114 and bore 134 bit receiving member 116. The damping mechanism 126 holds the two members together as illustrated in FIGS. 12 and 13. Additionally, the damping mechanism bar 26 provides torsional twisting movement between the two. While a press fit is used to hold these two members together, other types of mechanisms may be utilized to hold the two members together with respect to one another. The mechanism enables rotation of the body 114 and tool receiving member 116 with respect to one another while enabling a damping mechanism 126 or the like to provide the torsional spring to absorb the energy from the impact driver or drill motor.

Figure 17:
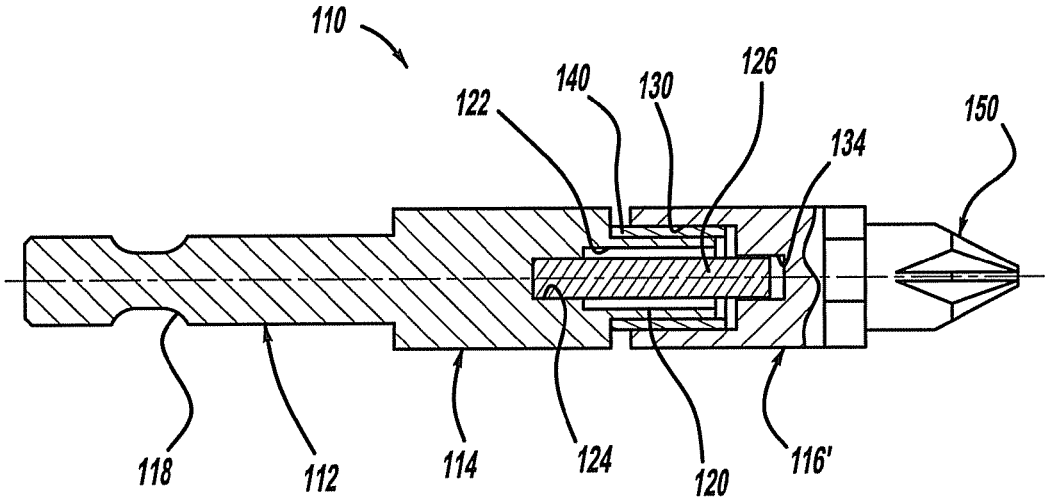
FIG. 17 is a view like FIG. 13 of a second embodiment.

FIG. 17 is a cross-section view like FIG. 13 of a third embodiment of the disclosure. The tool holder 110 is the same as that of the second embodiment except the front bore 132 in the tool receiving member 116' has been replaced with a unitary tool bit head 150. The tool bit head 150 is illustrated as a Phillips bit, however, any type of bit such as a torque, flat, socket or the like could be positioned on the bit member 16'. The remaining elements have been identified with the same reference number since they are the same.

FIG. 18 illustrates a another embodiment of a screwdriving tool bit with a damper illustrated with reference numeral 210. The screwdriving bit 210 includes an active end 212, a shanking end 214 and a damping mechanism 216. The active portion 212 is illustrated as a Phillips head screwdriver. It is understood that the Phillips head could be a flat head, Torx®, square, hexagon, star, socket, retaining member or the like tool bit head. The shanking end 214 is generally hexagonal shape with a groove 218 to be received into an impact driver or drill motor.

The damping mechanism 216 is illustrated as a torsional spring. The damping mechanism 216 is secured at one end to the active end 212 and at its other end to the shanking end 214. The damping mechanism 216 is a discreet member and has desired characteristics to provide dampening to dissipate energy from the impact driver to the tool bit. The damping mechanism may be secured to the active end 212 and shanking end 214 by welding, adhesives, interference fit, crimping, or fitting as described above or the like.

Additionally, the damping mechanism 216' could be manufactured from memory metal material, such as nitinol, that provides desired dampening characteristic. In this event, the nitinol portion is secured between the active end 212 and the shanking end 214 as illustrated in FIG. 18B. The memory metal material provides plastic deformation when torque is present to provide dampening from the impact driver to the tool bit. When the torque is removed, the memory metal springs back to its original position.

Figure 18A:
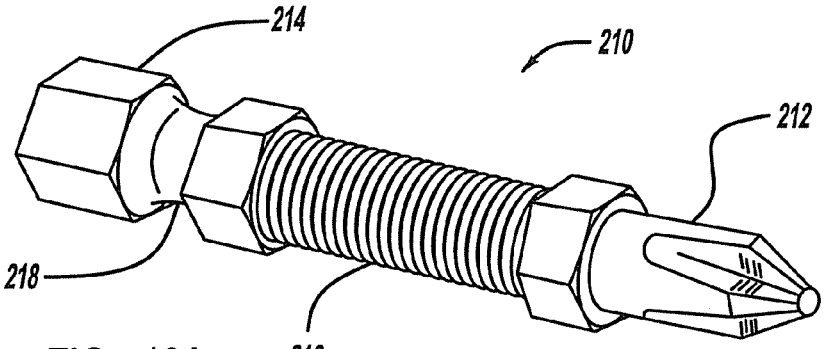
FIG. 18A is a perspective view of a screwdriver tool in accordance with the present disclosure.
Figure 18B:
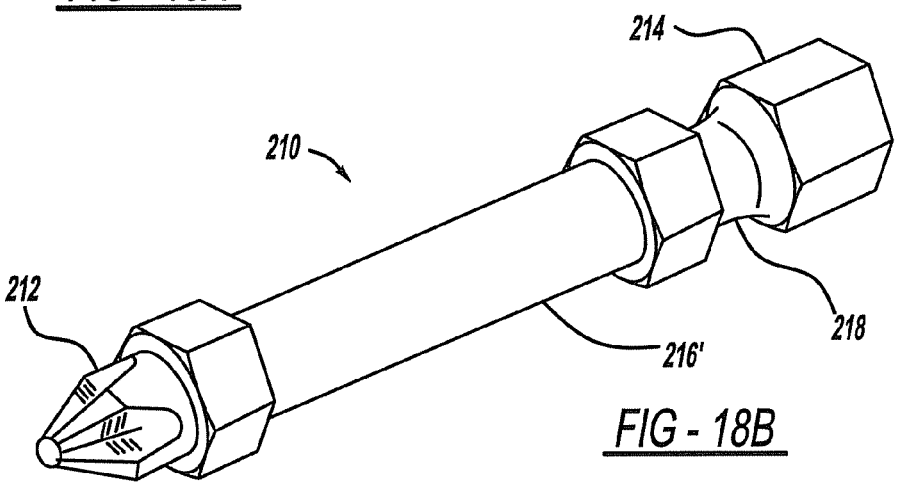
FIG. 18B is another perspective view of a screwdriver tool in accordance with the present disclosure.
Figure 19:
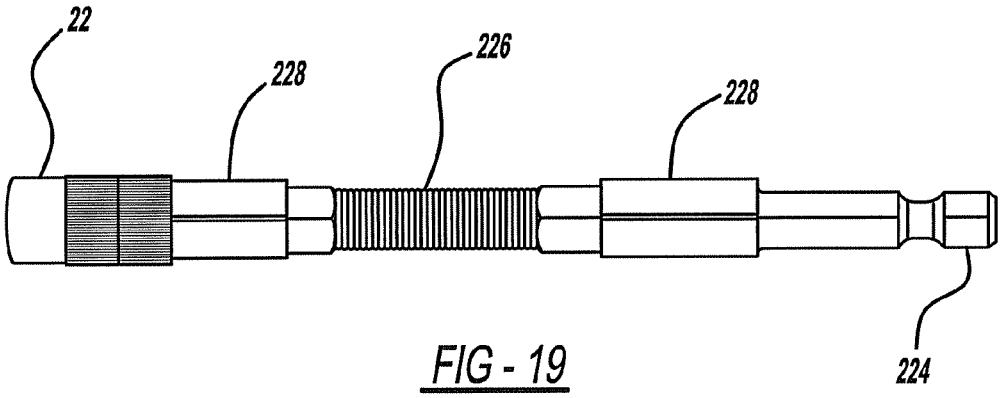
FIG. 19 is a perspective view of a second embodiment of a screwdriving tool in accordance with the present disclosure.

Turning to FIG. 19, another embodiment like that of FIG. 18A is illustrated. Here, the screwdriving tool includes an active end 222, a shanking end 224, and a damping mechanism 226. The damping mechanism 226 is like those previously discussed. Here, the active end 222 includes a retention member, such as a hex head socket. Additionally, the damping mechanism 226 may be secured to securement members 228 which, in turn, are secured with the shanking end 224 and the active end 222.

Figure 20A:
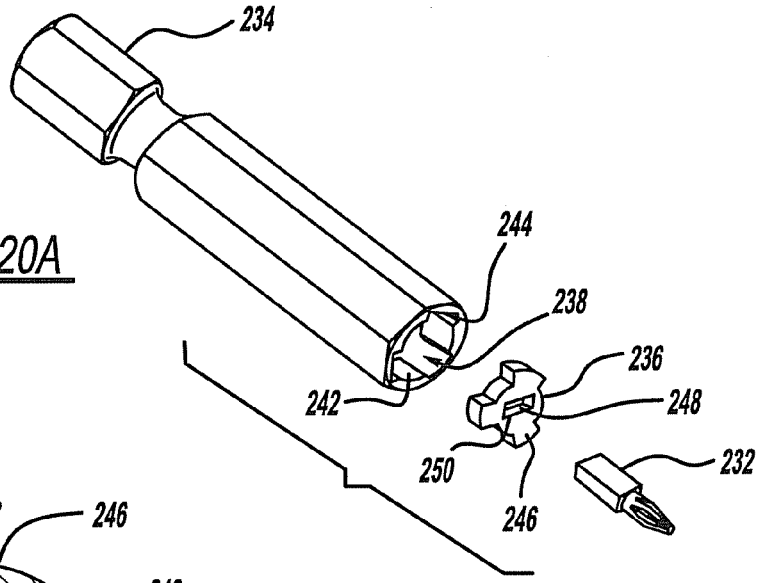
FIG. 20A is an exploded perspective view of another embodiment of a screwdriving tool.
Figure 20B:
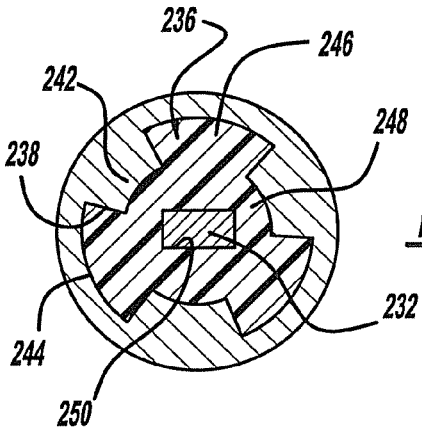
FIG. 20B is a cross section view along the embodiment of FIG. 20A.

Turning to FIG. 20, an additional embodiment is shown. Here, the embodiment includes a shanking end 234, an active end 232 and a damping mechanism 236. The shanking end 234 includes a bore 238. Raised portions 242 divide the bore 238. A series of valleys 244 are formed between the raised portions 242.

The damping mechanism 236 has a plurality of ears 246 that fit into the valleys 244 so that the damping mechanism 236 meshes in the bore 238. The body 248 of the damper includes a bore 250 to receive the active end 232. The damping mechanism 236 is manufactured from a soft elastic material, such as rubber, to enable it to absorb and dissipate the energy. Thus, as the impact driver is activated and the shanking end rotates, the damping mechanism 236 is compressed to absorb the energy. Additionally, torque may be applied to the active end 232 when the driven fastener bottoms out into the workpiece. Accordingly, after the torque is released, the damping mechanism 236 rotates and returns to its original shape.

Figure 21A:
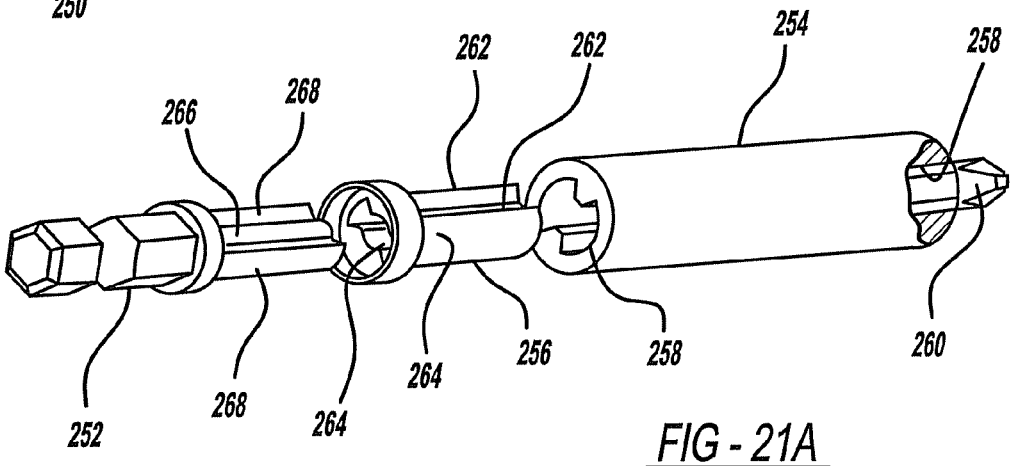
FIG. 21A is an additional embodiment of a screwdriving tool in accordance with the present disclosure.
Figure 21B:
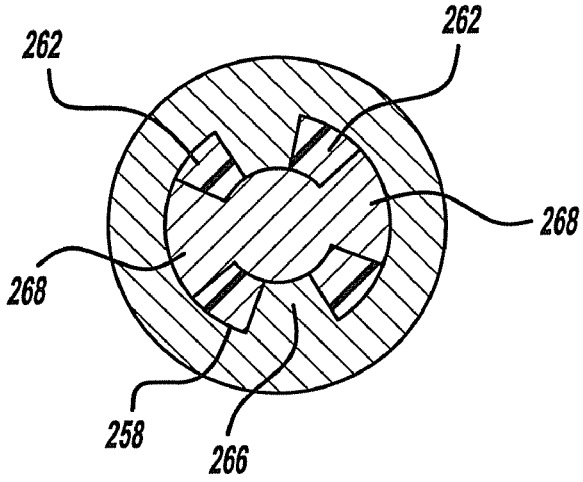
FIG. 21B is a cross section view through FIG. 21A.

Moving to FIG. 21, an additional embodiment is illustrated. Here, the screwdriver tool includes a shanking end 252, a sleeve 254, and a damping mechanism 256. The sleeve 254 includes a bore 258 to receive a screwdriver bit 60 as well as the damping mechanism 256. The damping mechanism 256 includes an external configuration to fit within the sleeve bore 258. The damping mechanism 256 includes two D-shaped ears 262 connected by a body 264. The D-shaped ears 262 compress when torque is applied. The damping mechanism 256 also includes a bore 264 to receive the shanking end 252. The shanking end 252 includes an elongated member 266 with two D-shaped members 268 that fit inside of the damping mechanism 256. Thus, as the shanking end 252 or active end is rotated, the damping mechanism 256 absorbs and dissipates the energy to the sleeve 254.

Figure 22:
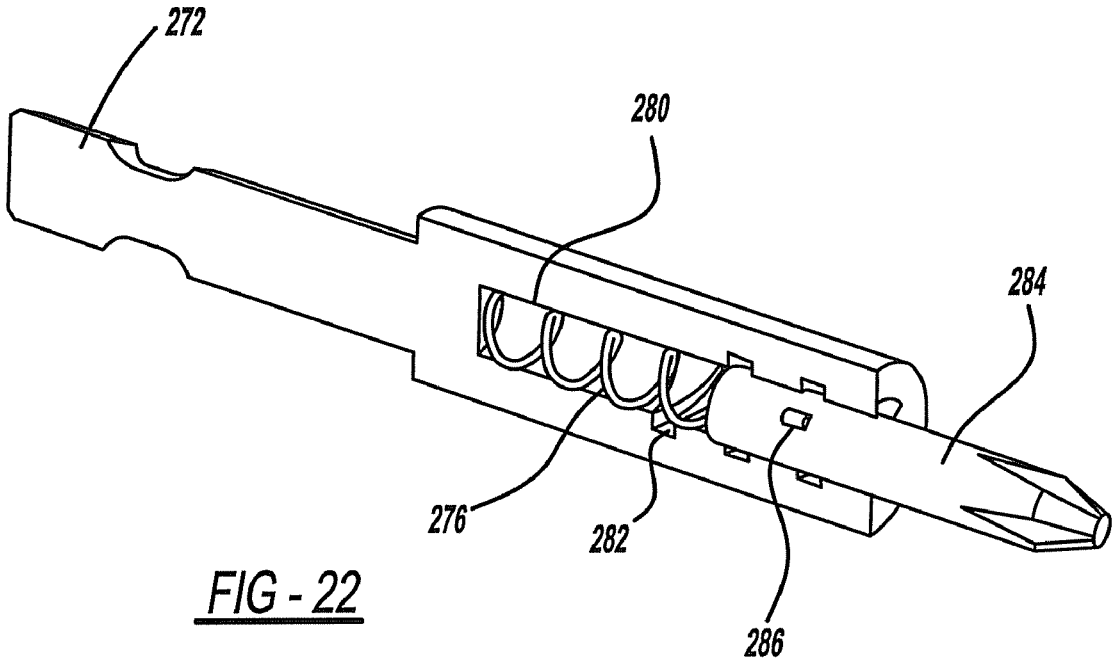
FIG. 22 is a cross section view of an additional embodiment of a screwdriving tool in accordance with the present disclosure.

FIG. 22 illustrates an additional embodiment of the screwdriving tool. The tool includes a shanking end 272 and a body portion 274. The shanking end 272 is unitarily formed with the body portion 274. The body portion 274 includes a bore 276. The bore 276 receives a helical spring 280. Additionally, a helical thread 282 is formed in the wall of the bore 276. A screwdriver bit 284, with at least one projection 286 seated in the helical thread 282, is positioned in the bore 276. Thus, as the impact driver imparts torque onto the shanking end 272, the shanking end 272 rotates which, in turn, rotates the body 274 to enable the screwdriver bit 284 to rotate. As this occurs, the projection 286 rides in the thread 282 so that the screwdriver bit 284 compresses the spring 280 dampening the torque. Additionally, torque may be applied to the screwdriver bit 284 when the driven fastener bottoms out into the workpiece. Accordingly, the screwdriver bit 284 would rotate along the thread 282 into the body portion 274. Once the torque is released, the spring 280 forces the screw driver bit 284 outward, rotating the projection 286 along the helical path of the thread 282, until the screwdriver bit reaches its original position.

Figure 23:
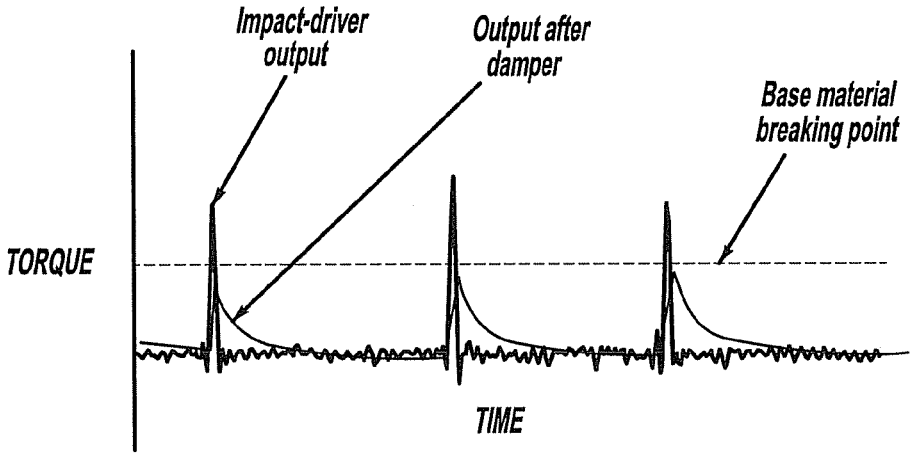
FIG. 23 is a graph of torque versus time.

FIG. 23 is a graph of torque versus time for the impact-driver, impact-driver after damping, and material breaking torque. The large peaks illustrates (solid line) the large driving torque from an impact driver in the range of 500 inch-lbs that cycles about every 2 milliseconds. The dashed line is the torque rating of the tool holder and tools in the range of about 200 inch-lbs. The lower peak (dot and dash line) is the drive torque with a tool holder or tool as described above on the impact driver cycling every 2 milliseconds. The peak torque does not exceed the torque rating of the tool or tool holder. Accordingly, the disclosed tool holder or tool reduces breakage of the tools or tool holders.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An impact resistant tool comprising:

a tool holder body defining an axis and having a first and second end, said first end having one of a tool receiving attachment and a tool, and said second end having a shank receiving bore, said holder body including a pocket between said first and second ends, said pocket defined by a first plurality of walls defining a generally polygonal cross-section;

a shank defining an axis, said shank having a first and second end, said first end having a mating configuration for being received in said shank receiving bore of said holder body, said shank first end being able to rotate in said shank receiving bore, said shank second end having a configuration for mating with a power tool, said shank including a pocket between said first and second ends, said pocket defined by a second plurality of walls defining a generally polygonal cross-section;

a rotation limiting mechanism coupled with said holder body and said shank for limiting rotation of said holder body and shank with respect to one another; and a damping mechanism received in said holder body pocket and said shank pocket, said damping mechanism having a polygonal cross-section for fitting into said pockets and configured to absorb a torsional force when said shank rotates relative to said holder body, wherein at least one of the first plurality of walls and the second plurality of walls includes a recessed portion for receiving a portion of material of the damping mechanism when the damping mechanism deforms to absorb the torsional force.

2. The tool of claim 1, wherein said damping mechanism comprises a bar made from a shape memory material.

3. The tool of claim 1, wherein said recessed portion is defined by at least one surface extending away from one of said walls forming an acute angle with the one wall providing a wedge shaped void.

4. The tool of claim 1, wherein the rotation limiting mechanism comprises at least one pin positioned in a recess in said holder body or said shank.

5. An impact resistant tool comprising:

an active end for driving a fastener, said active end including a body defining an axis, a shank receiving bore in said body and a pocket;

a shank for securing with a power tool, said shank including an end for being received in said shank receiving bore in said body, and said shank including a pocket; said shank having limited rotation with respect to said body;

a damping mechanism received in said pockets configured to provide damping between said body and said shank, said pockets further comprising at least one transition zone for receiving material from said damping mechanism as the damping mechanism deforms in response to torque applied onto the tool.

6. The impact resistant tool of claim 5, wherein said active end comprises at least one of a fastening head, a bit receiving bore, a socket head, a pivoting holder, a quick release holder, and a drop and load holder.

7. The impact resistant tool of claim 5, further comprising a mechanism for limiting rotation of said body with respect to said shank.

8. A tool bit driving tool comprising:

a shank having a rear end configured to be secured in a power tool, and a front end defining a front pocket;

a body coupled to the shank for limited rotation relative to the shank, the body having a rear end defining a rear pocket and a front end configured to be coupled to a tool bit; and a damping bar received in the front pocket and the rear pocket, the damping bar configured to provide torsional damping between the body and the shank, wherein at least one of the front pocket and the rear pocket includes a transition zone for receiving material from the damping bar as the damping bar deforms in response to torque applied onto the tool bit driving tool.

9. The tool bit driving tool of claim 8, wherein the damping bar comprises a shape memory material.

10. The tool bit driving tool of claim 8, wherein the damping bar is press fit into at least one of the body and the shank.

11. The tool bit driving tool of claim 8, wherein the body defines a bore to receive a tool bit.

12. The tool bit driving tool of claim 8, where in the tool bit is unitarily connected with the body.

13. The tool bit driving tool of claim 8, wherein the at least one of the front pocket and the rear pocket with the transition zone has a plurality of walls defining a polygonal cross-section.

14. The tool bit driving tool of claim 13, wherein the transition zone comprises at least one recess in at least one of the plurality of walls.

15. The tool bit driving tool of claim 14, wherein each of the at least one recess is defined by at least one surface extending away from one of the walls, forming an acute angle with the one wall to provide a wedge shaped void.

16. The tool bit driving tool of claim 13, wherein the damping bar has a cross-section that corresponds to the polygonal cross-section.

* * * * *